US010383439B2

(12) United States Patent
Byrne et al.

(10) Patent No.: US 10,383,439 B2
(45) **Date of Patent: *Aug. 20, 2019**

(54) SWING STOOL ARM

(71) Applicant: Get Back, Inc., Oakville, CT (US)

(72) Inventors: Timothy Michael Byrne, Sandy Hook, CT (US); Edward George Acciardi, Grafton, MA (US)

(73) Assignee: Get Back, Inc., Oakville, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/361,312

(22) Filed: Mar. 22, 2019

(65) Prior Publication Data

US 2019/0216218 A1 Jul. 18, 2019

Related U.S. Application Data

(62) Division of application No. 16/071,966, filed as application No. PCT/US2017/017285 on Feb. 10, 2017.

(60) Provisional application No. 62/293,864, filed on Feb. 11, 2016.

(51) Int. Cl.

| | |
|---|---|
| ***A47B 83/02*** | (2006.01) |
| ***A47C 9/02*** | (2006.01) |
| *A47B 13/02* | (2006.01) |

(52) U.S. Cl.

CPC ..... *A47B 83/0213* (2017.08); *A47C 9/022* (2013.01); *A47B 13/021* (2013.01)

(58) Field of Classification Search

CPC .... A47B 83/0213; A47B 13/021; A47C 9/022

USPC ..... 297/137, 140, 141, 142, 157.1, 158.3, 297/158.4, 158.5, 159.1, 195.1, 195.11, 297/344.21, 461

See application file for complete search history.

(56) References Cited

U.S. PATENT DOCUMENTS

| | | | | |
|---|---|---|---|---|
| 57,255 A | | 8/1866 | Marx | |
| 113,607 A | | 4/1871 | Wilson | |
| 116,023 A | * | 6/1871 | Christian | A47C 9/022 297/142 |
| 272,901 A | * | 2/1883 | Richardson | A47C 9/022 297/142 |

(Continued)

FOREIGN PATENT DOCUMENTS

| | | | |
|---|---|---|---|
| EP | 0021089 | A2 | 1/1981 |
| KR | 20100103438 | A | 9/2010 |

(Continued)

OTHER PUBLICATIONS

PSI, Search by Industry: WMS-200 Wall Mount Swing Stool, last viewed Feb. 20, 2015.

(Continued)

*Primary Examiner* — Rodney B White
(74) *Attorney, Agent, or Firm* — Mark Nowotarski

(57) ABSTRACT

A swing stool arm for use in a swing stool has a horizontal top flange, a horizontal bottom flange, a vertical end flange at a proximal end of the arm, a web extending down from the top flange and up from the bottom flange, and a vertical fillet at the proximal end of the arm. The vertical fillet joins the vertical end flange to the web. The vertical fillet has an open cavity so that the swing stool arm can be made from a cast molten aluminum alloy without forming shrinkage cavities.

7 Claims, 12 Drawing Sheets

(56) References Cited

U.S. PATENT DOCUMENTS

| | | | | | |
|---|---|---|---|---|---|
| 283,512 | A | | 8/1883 | Reynolds | |
| 435,307 | A | | 8/1890 | Hill | |
| 478,987 | A | * | 7/1892 | Colby | A47B 83/02 297/142 |
| 508,961 | A | * | 11/1893 | Moss | A47C 9/022 297/142 |
| 536,577 | A | * | 3/1895 | Mallett | A47C 9/022 297/142 |
| 553,108 | A | * | 1/1896 | Davison | A47B 83/02 297/142 |
| 598,105 | A | | 2/1898 | Lind | |
| 953,823 | A | | 4/1910 | Ellsworth | |
| 1,182,850 | A | | 5/1916 | Little | |
| 1,219,324 | A | | 3/1917 | Johnson | |
| 1,337,221 | A | | 4/1920 | Hansen | |
| 1,346,976 | A | * | 7/1920 | Rankin | A47B 39/04 297/142 |
| 1,375,166 | A | | 4/1921 | Mestre | |
| 1,379,263 | A | * | 5/1921 | Jellinek | A47C 9/022 297/142 |
| 1,489,982 | A | * | 4/1924 | Dailey | A47C 9/022 297/142 |
| 1,579,823 | A | * | 4/1926 | Langguth | A47C 9/022 108/26 |
| 1,584,896 | A | | 5/1926 | Sivon | |
| 1,656,812 | A | * | 1/1928 | Balko | A47B 23/02 108/105 |
| 1,688,415 | A | * | 10/1928 | Fox | A47C 9/022 248/126 |
| 1,876,308 | A | * | 9/1932 | Colley | A47B 39/00 248/282.1 |
| 1,944,765 | A | * | 1/1934 | Sheldon | A47B 39/00 297/142 |
| 2,024,045 | A | * | 12/1935 | Johnson | A47B 83/02 248/416 |
| 2,077,337 | A | | 4/1937 | Lifvendahl et al. | |
| 2,339,647 | A | * | 1/1944 | Meyer | A47B 77/10 101/DIG. 36 |
| 2,510,900 | A | | 6/1950 | O'Neil | |
| 2,782,837 | A | * | 2/1957 | Munsch | A47B 3/14 108/92 |
| 3,033,614 | A | | 5/1962 | Pazan | |
| 3,226,154 | A | * | 12/1965 | Allen | A47B 83/02 297/142 |
| 3,512,742 | A | | 5/1970 | Robson, Jr. | |
| 3,547,484 | A | * | 12/1970 | Allen | A47B 83/02 297/141 |
| 3,658,379 | A | | 4/1972 | Black et al. | |
| 3,709,555 | A | * | 1/1973 | Ostertag | A47B 83/02 248/417 |
| 3,920,276 | A | * | 11/1975 | Sparrow | A47C 9/022 108/139 |
| 3,951,449 | A | * | 4/1976 | Crowther | A47B 83/02 297/142 |
| 4,071,216 | A | | 1/1978 | Einhorn | |
| D313,933 | S | | 1/1991 | Petley | |
| 5,104,183 | A | * | 4/1992 | Madsen | A47C 9/022 297/142 |
| 5,556,164 | A | * | 9/1996 | Cindea | A47C 9/025 248/425 |
| D384,576 | S | | 10/1997 | Holder | |
| 6,899,385 | B2 | * | 5/2005 | Pernicka | A47B 83/02 297/142 |
| D634,310 | S | | 3/2011 | Knaapen | |
| 10,278,495 | B2 | * | 5/2019 | Byrne | A47C 9/022 |
| 2012/0319437 | A1 | * | 12/2012 | Conner | A47C 3/12 297/142 |
| 2015/0157131 | A1 | | 6/2015 | Battey et al. | |
| 2015/0238016 | A1 | | 8/2015 | Schmitz et al. | |
| 2016/0374472 | A1 | * | 12/2016 | Horn | A47C 3/18 297/344.21 |

FOREIGN PATENT DOCUMENTS

| | | |
|---|---|---|
| KR | 20110006859 | 7/2011 |
| KR | 20120091660 | 8/2012 |

OTHER PUBLICATIONS

Chairs & Stools Direct, 8 Seater Dining Table With Swing Out Stools, last viewed Feb. 20, 2015.
Chairs & Stools Direct, 6 Seater Dining Table With Swing Out Stools, Feb. 20, 2015.
BioFit, BioFit Delivers Business Center Seating Alternatice, last viewed Feb. 20, 2015.
BioFit, BioFit 1Y-Series Wall Mounted Stools, last viewed Feb. 20, 2015.
Crown Ltd, Swing Out Stool—Yacht Navigation & Vanity Stool, last viewed Feb. 20, 2015.
Barina Craft, Loft Home's Kitchen Bar Design Hinges On Swing Out Stool Seating, last viewed Feb. 20, 2015.
andythornton.com, Factory Refectory Table With Swing-Out Seats, last viewed Feb. 20, 2015.
1stdibs.com, Impressive Industrial Metal Iron Table w/Six Swing-Out Stools, last viewed Feb. 20, 2015.
Albert Stumm, Passyunk Post, Stateside installs stools outside—bolted to the wall, last viewed Feb. 20, 2015.
Cell Security Ltd, CSL0537 Wall Mounted Steel Stools, last viewed Feb. 20, 2015.
Better Home Lifestyle, Spaces Craftsman Los Angeles, last viewed Feb. 20, 2015.
weebly.com, Noelke Art-Custom Art, Fine Metalwork & Classes (/),last viewed Feb. 20, 2015.
Waaat?, Truth Coffee by Haldane Martin/Design, last viewed Feb. 20, 2015.
Seating Innovations, last viewed Feb. 20, 2015.
peppermillantiques.com, Industrial Style Desk Table With Swing Out Stools, last viewed Feb. 20, 2015.
getbackinc.com, "Dept 87" Original Swing Out Seat, http://www.getbackinc.com/shop/dept-87/dept-87-original-swing-out-seat/, Jun. 30, 2015.
getbackinc.com, Dept 87 Original Swing Out Seat, Jun. 30, 2015.
en.wikipedia.org, Carriage Bolt, https://en.wikipedia.org/wiki/Carriage_bolt, Mar. 10, 2015.
matweb.com, Aluminum A357.0-T62, Cast, last viewed Feb. 4, 2016.
Cast Iron Properties, http://www.anvilfire.com/article.php?bodyName+/FAQs/cast_iron.htm, last viewed Feb. 4, 2016.
getbackinc.com, "Dept 87" Swing Out 6-Seat Table Cast Iron & Wood, last viewed Jan. 23, 2016.
ebay.com, Victorian Cast Iron Ice Cream Table w/attached Swing Out Seat, last viewed Jan. 15, 2016.
antiquesdirect.ca, Industrial Furniture, Industrial Iron Side Table with swing out seating, last viewed Jan. 15, 2016.
English abstract KR 20100103438A, applicant Hanaro OA Furniture, published Sep. 27, 2010.
English abstract KR 20110006859, applicant Kyo Yeol Koo, published Jul. 7, 2011.
English abstract KR 20120091660, applicant Yun Jung Lim, published Aug. 20, 2012.
PCT ISA International Search Report for PCT/US2017/017285, applicant Get Back, Inc., dated May 11, 2017.
PCT Written Opinion of the ISA for PCT/US2017/017285, applicant Get Back, Inc., dated May 11, 2017.
anythornton.com, Factory Refectory Table with Swing-Out Seats, last viewed Jan. 15, 2016.
1stdibs.com, Impressive Industrial Metal Iron Table w/Six Swing-Out Stools, last viewed Jan. 15, 2016.
1stdibs.com, Swing out seat, last viewed Jan. 15, 2016.
ebay.com, Swing out seat, last viewed Jan. 15, 2016.
andythornton.com, Swing out seat, last viewed Jan. 15, 2016.
en.wikipedia.org, Core (manufacturing), https://en.wikipedia.org/wiki/Core, last viewed Feb. 2, 2016.

(56) References Cited

OTHER PUBLICATIONS en.wikipedia.org, Geometric terms of location, https://en.wikipedia.org/wiki/Geometric_terms_of_location, last viewed Feb. 2, 2016.
en.wikipedia.org, I-beam, https://en.wikipedia.org/wiki/I-beam, last viewed Feb. 2, 2016.
English translation of EP 0021089 A2, Working position unit by Thies et al. published Jan. 7, 1981.

* cited by examiner

SWING STOOL ARM

CROSS-REFERENCE TO RELATED APPLICATIONS

The present application is a divisional of U.S. application Ser. No. 16/071,966, filed Jul. 23, 2018, now U.S. Pat. No. 10,278,495 B2, which is a U.S. National Stage application under 35 U.S.C. § 371 of International Application PCT/US2017/017285, filed Feb. 10, 2017, which claims priority from Provisional Patent Application No. 62/293,864 filed on Feb. 11, 2016, of which are incorporated herein by reference.

FIELD OF INVENTION

The inventions described herein are generally in the field of tables with seats movably mounted thereto.

BACKGROUND

FIG. 1 is a perspective drawing of a prior art swing stool table 100. The table comprises a horizontal top 102, one or more vertical posts 104, a longitudinal support beam 106, one or more swing stools 108 and one or more footplates 110. The swing stools each comprise a lateral bracket 112 mounted to the beam, a pivot bolt 116 forming a hinge, an arm 114 extending horizontally from the bolt, and a seat 118 mounted on the distal end of the arm. When not in use, the arm may be rotated about the bolt so that the seat rests adjacent to the beam and under the top of the table. When in use, the arm may be swung out 132 so that the seat extends laterally away from the top of the table and a person can sit on it. The top, posts, plates, brackets and arms are all made of steel or cast iron. The beam and seats are made of wood.

In order for the table to be steady, it must be designed so that the outward tipping torque 160 about the lateral edge 154 of the footplates 110 is negative (i.e. the net torque is holding the table down). This must be true when all of the seats on one side of the table are swung out and occupied by heavier-than-average people and all of the seats on the opposite side are folded in and not occupied. The net torque can be calculated by summing the torque due to the weight of the table and the torque due to the weight of the persons occupying the seats. The torque of the table is determined from the table weight 162 and the lateral distance from the table center of mass 163 to the lateral edge of the plates when the seats on the distal side of the table are folded in and the seats on the proximal side of the table are folded out. This distance is equal to the difference between the lateral plate extension 152 from the longitudinal centerline 120 of the table and the center of mass lateral offset 164 from the longitudinal centerline of the table. The table center of mass is laterally offset from the longitudinal centerline of the table because the seats on the proximal side are swung out and the seats on the distal side are folded in.

The torque of a person occupying a seat can be calculated from the weight of the persons 166 and the lateral extension 134 of the center of the seat 136 from the longitudinal centerline of the table 120 minus the lateral plate extension 152. As used herein, the "center of a seat" is the position where the center of mass of a person sitting in a seat would be. For circular seats, this is about where the geometric center of the seat is. For non-circular seats, it may be where the seat is designed for a person to sit (e.g. a formed area). In the illustrated prior art design, the table weight is about 272.4 kg. The top lateral extension 122 and the plate lateral extension are both about 38.1 cm. The seat lateral extension is about 52.1 cm. The plate extension is about the same as the top extension so that the plates do not extend laterally past the top lateral edge 124 of the table. This makes the table easier to ship when assembled. The prior art design allows for three larger than normal individuals each weighing 181 kg to sit on one side of the table without tipping. The table would tip, however, if the table mass was less.

FIG. 2 is a perspective drawing of the swing stool 132 of FIG. 1 after it has been swung out. The stool comprises a lateral bracket 112 mounted to the longitudinal beam 106. A hinge connection to the arm 114 is formed by the vertical pivot bolt 116. The distal end of the arm comprises a horizontal seat plate 220 (not visible in this drawing). The seat 118 is attached to the seat plate. The arm has a generally bent "I" beam shape comprising a top flange 202, bottom flange 204 and web 210. An opening 212 is provided in the web to reduce weight. The proximal end of the arm comprises a vertical end flange 216. A vertical end fillet 214 is provided on both sides of the web and the outward face of the end flange to strengthen the arm against twisting 206 when a person sits in the seat.

The proximal end of the top flange further comprises a horizontal top disk 217. The proximal end of the bottom flange comprises a horizontal bottom disk 218. Corresponding disks are provided on top 232 and bottom 234 flanges of the bracket. The bracket also has a generally "I" beam shape with top and bottom flanges, webs and an opening in the web. Holes are provided in the centers of the disks for the pivot bolt to pass through to form a hinge.

The top and bottom flanges of the arm extend outwardly and bend both laterally 222 and upwardly 224 relative to the bracket 112 to join together at the distal end of the arm. The seat plate is mounted horizontally on said distal end of the arm. The bend in the arm is provided so that a person, such as a woman wearing a skirt, may sit on the stool without having to raise a leg over the arm. The bend in the arm, however, causes a significant twisting torque 206 about the longitudinal centerline 236 of the bracket when a person sits on the seat. This can cause sag 208 in the distal end of the arm. When the arm is made from ductile cast iron, the sag is calculated to be about 2.5 mm for a 181 kg person. This is acceptable sag. The twisting torque also produces significant stresses in the arm. The maximum stress for a 181 kg person is calculated to be about 89 Mpa. The yield strength of ductile cast iron is about 551 Mpa. Thus there is about a 6× safety factor in the yield strength versus the maximum expected stresses. Safety factors of 2× or greater are considered acceptable.

One of the disadvantages of the prior art design is the large weight of the table. This large weight is required so that the table will not tip over when larger than average persons all sit on one side of the table. The high table weight makes the table unsuitable for most home use. It is also too heavy to be provided in a kit form for an average homeowner or apartment resident to take home and assemble.

The weight of the table can be reduced by using lower weight metals in the swing stools. The design of the arm and bracket, however, must be changed or the seat will have too much sag. The stresses in the arm might also exceed the yield strength of the lighter weight metals. Furthermore, a lower weight table with the prior art design will no longer be stable with several large persons sitting on one side and no one sitting on the other side. Thus there is a need for an improved seat design suitable for lighter material construction, an improved table design that the table is stable for sitting, and a kit design for the table that is suitable for home assembly.

SUMMARY OF INVENTION

The summary of the invention is a guide to understanding the invention. It does not necessarily describe the most generic embodiment or all alternative embodiments.

FIG. 3 is a perspective drawing of a swing stool table kit 300 that has been assembled. The table comprises a horizontal top 302 mounted on one or more vertical posts 304. A horizontal beam 306 is mounted longitudinally on the posts. One or more swing stools 310 are mounted on the beam. The swing stools are made from a lightweight metal, such as aluminum or an aluminum alloy. The posts are mounted on one or more horizontal footplates 308.

Each swing stool comprises a lateral bracket 318 mounted on the beam. The bracket extends outwardly at right angles from the beam. A pivot bolt 316 joins the distal end of the bracket to the proximal end of an arm 314. The joint is a hinge joint. A seat 312 is mounted horizontally on a seat plate (not shown) on the distal end of the arm. An enlarged vertical fillet 321 is provided at the proximal end of the arm to resist twisting of the arm when a person sits on the seat. An optional open cavity 320 is provided in the fillet at the proximal end of the arm to facilitate manufacture of the arm by casting. If the fillet were cast as without the cavity, the large thickness of the fillet would cause the molten cast metal to cool slowly and potentially lead to shrinkage cavities. It is surprising that the fillet is effective at resisting twisting of the arm considering it has a relatively large open cavity.

The top, beam and seats may be made of wood, plastic or other lightweight structural materials. The arm and bracket may be made of aluminum, magnesium, titanium or other lightweight metal. The arm or bracket may alternatively be made from plastic, fiberglass, carbon fiber or other lightweight high strength structural material. A suitable material for the arm and bracket is the 357 aluminum alloy. Published properties of cast 357 aluminum alloy are:

Young's modulus=about 80 GPa

Density=about 2.8 gm/cm$^3$

Tensile strength=about 360 Mpa

Yield strength=about 290 Mpa

The overall weight of a six stool table with wooden top, beam and seats; aluminum brackets and arms; and steel posts, plates and bolts is about 106 kg. A table with six swing out stools suitable for provision as a kit for home assembly should have a total weight of not more than 150 kg.

In order to make the table stable when three heavy persons are sitting on one side, the horizontal plate lateral edge extension 336 from the table longitudinal centerline 330 is set to a value between the table lateral extension 332 and the stool lateral extension 334. A plate extension of about 44 cm is suitable when the top extension is about 38 cm and the stool extension is about 52 cm. This design will not tip over even if 181 kg people occupy all seats on one side of the table with no persons in the opposite seats and all of the opposite seats folded under the table. The additional plate extension beyond the lateral edge of the table doubles the capacity of table to hold people on one side relative to the prior art design if the prior art design were made of similar lightweight materials. No undue tripping hazard is formed since the bottom plates do not extend past the seats.

DETAILED DESCRIPTION

The detailed description describes non-limiting exemplary embodiments. Any individual features may be combined with other features as required by different applications for at least the benefits described herein. As used herein, the term "about" means plus or minus 10% of a given value unless specifically indicated otherwise.

A portion of the disclosure of this patent document contains material to which a claim for copyright is made. The copyright owner has no objection to the facsimile reproduction by anyone of the patent document or the patent disclosure, as it appears in the Patent and Trademark Office patent file or records, but reserves all other copyright rights whatsoever.

As used herein, the term "shaped" means that an item has the overall appearance of a given shape even if there are minor variations from the pure form of said given shape.

As used herein, the term "generally" when referring to a shape means that an ordinary observer will perceive that an object has said shape even if there are minor variations from the ideal form of said shape.

As used herein, relative orientation terms such as "up", "down", "top", "bottom", "left", "right", "vertical", "horizontal", "distal" and "proximal", "lateral" and "longitudinal" are defined with respect to an initial presentation of an object and will continue to refer to the same portion of an object even if the object is subsequently presented with an alternative orientation, unless otherwise noted.

Low Weight Swing Stool Design

Figure 3:
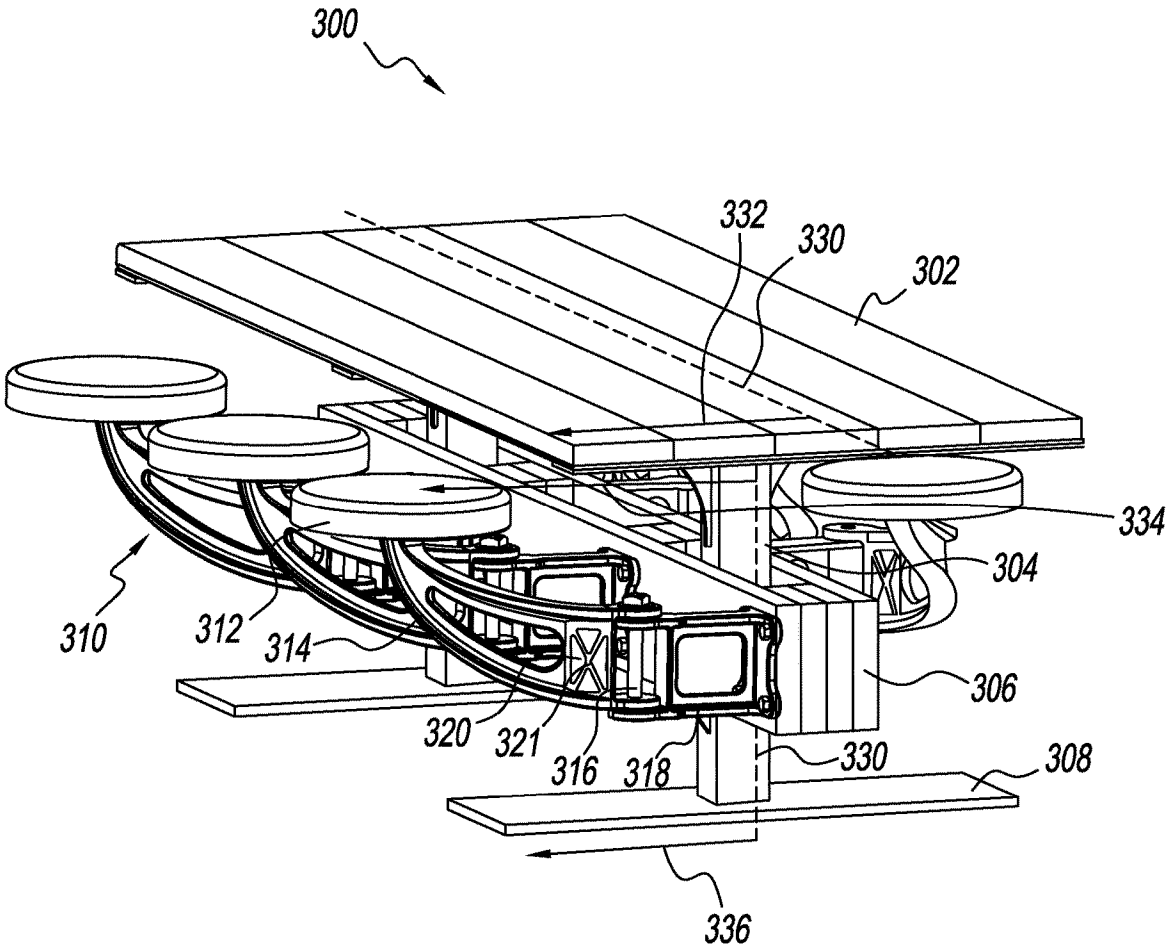
FIG. 3 is a perspective drawing of a swing stool table kit that has been assembled.
Figure 4B:
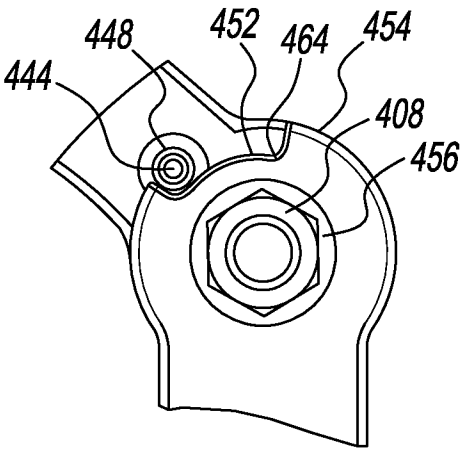
FIG. 4B is a partial bottom view of the swing stool of FIG. 4A after it has been assembled.
Figure 4A:
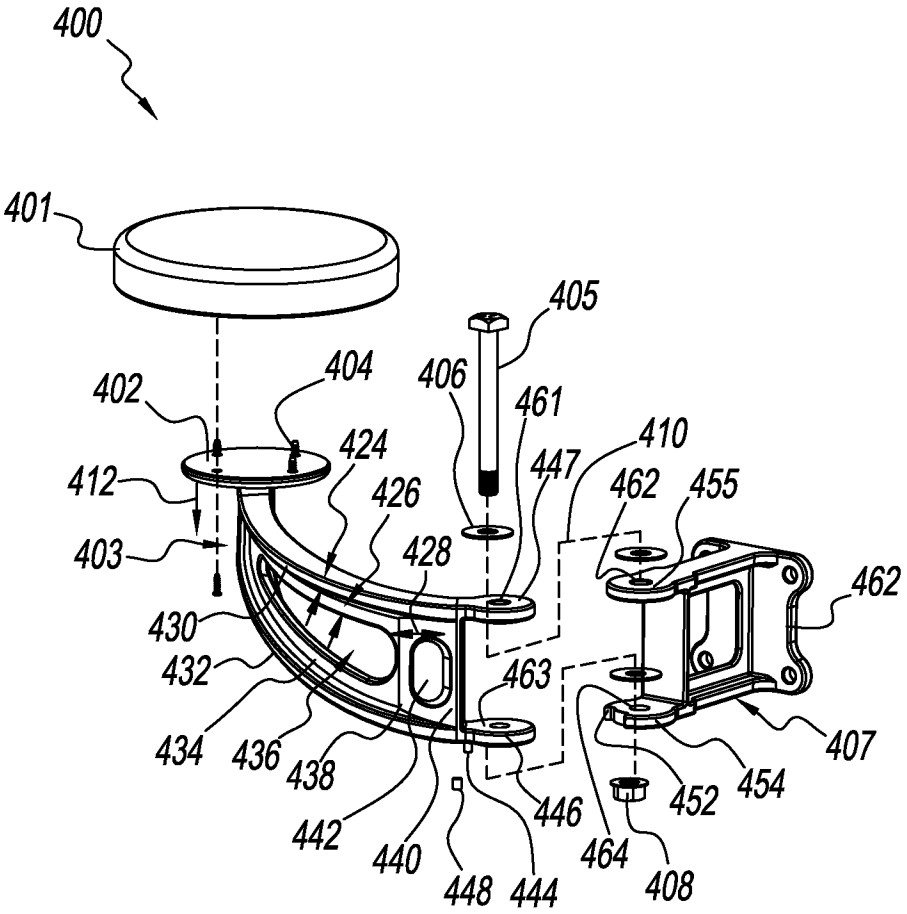
FIG. 4A is an exploded perspective drawing of a low weight swing stool.

FIG. 4A is an exploded perspective drawing of a low weight swing stool 400 similar to the swing stool 310 of FIG. 3. The swing stool comprises a seat 401, a seat plate 402, an arm 403, a pivot bolt 405 and a bracket 407. The seat may be made of wood, plastic or other material that would be comfortable to sit on. It may have a low thermal conductivity so as to not to chill a person sitting on it. The seat is mounted on the horizontal seat plate and attached by one or more screws 404. Other joining means may be used, such as glue, snaps or hook and loop fasteners (e.g. Velcro® brand). The seat plate is mounted on the distal end of the arm. The arm may be made of a lightweight metal alloy such as 357 aluminum alloy. The seat plate may be attached by any means, such as being welded to the arm or cast with the arm as a single piece. The proximal end of the arm is hingedly joined to the distal end of the bracket by the pivot bolt. Any hinge configuration may be used. The proximal end of the bracket comprises a vertical end flange 462 for mounting on a vertical surface, such as the side of a beam. The proximal end of the arm may comprise a top disk 447 and a bottom disk 446. The distal end of the bracket may comprise a top disk 455 and bottom disk 454. One or more washers 406 may be provided between the disks of the bracket and arm so that the disks do not bend when the arm is swung. A washer may also be provided between the head of the pivot bolt on the top of the top disk of the arm so that the bolt does not deform the softer arm alloy when the swing stool is assembled and an end nut 408 is tightened on said bolt. The bolt may be made of steel. An assembly line 410 is shown to illustrate how the hinge at the proximal end of the arm is assembled. Holes 461, 462, 463 and 464 may be provided in the centers of said disks for the bolt to pass vertically therethrough and provide the hinge joint.

The arm has a generally "I" beam vertical cross section with a top horizontal flange 430, bottom horizontal flange 432 and vertical web 434 extending inwardly from said top and bottom flanges. The arm is bent laterally and upwardly relative to the bracket. The top and bottom flanges are curved together and joined at their distal ends. A vertical opening 436 may be provided in the web. A vertical fillet 438 is provided which extends horizontally and obliquely from the outer edges of a vertical end flange 440 to the inside edge of the opening in the web. An open top cavity 442 may be provided in the fillet extending inwardly from the outer surface of the fillet to the outer surface of the web underneath the fillet. The cavity may alternatively extend into the web or even through the web to form an opening through the arm. A corresponding fillet and open top cavity may be provided on the other side of the web.

A vertical pin 444 may extend downward from about the circumference of the bottom disk 446 of the arm. A bushing 448 may be provided on the pin. The bushing may be free to rotate on the pin. A race 452 corresponding to the bushing and pin assembly may be cut in the outer edge of the bottom disk 454 on the distal end of the bottom flange of the bracket. The race limits the range of travel for the bushing and hence the arm when the swing stool is assembled and the arm is swung in or out. The race may be dimensioned to prevent the arm from hyperextending when it is swung out and prevent the seat from hitting the table when swung in.

Figure 1:
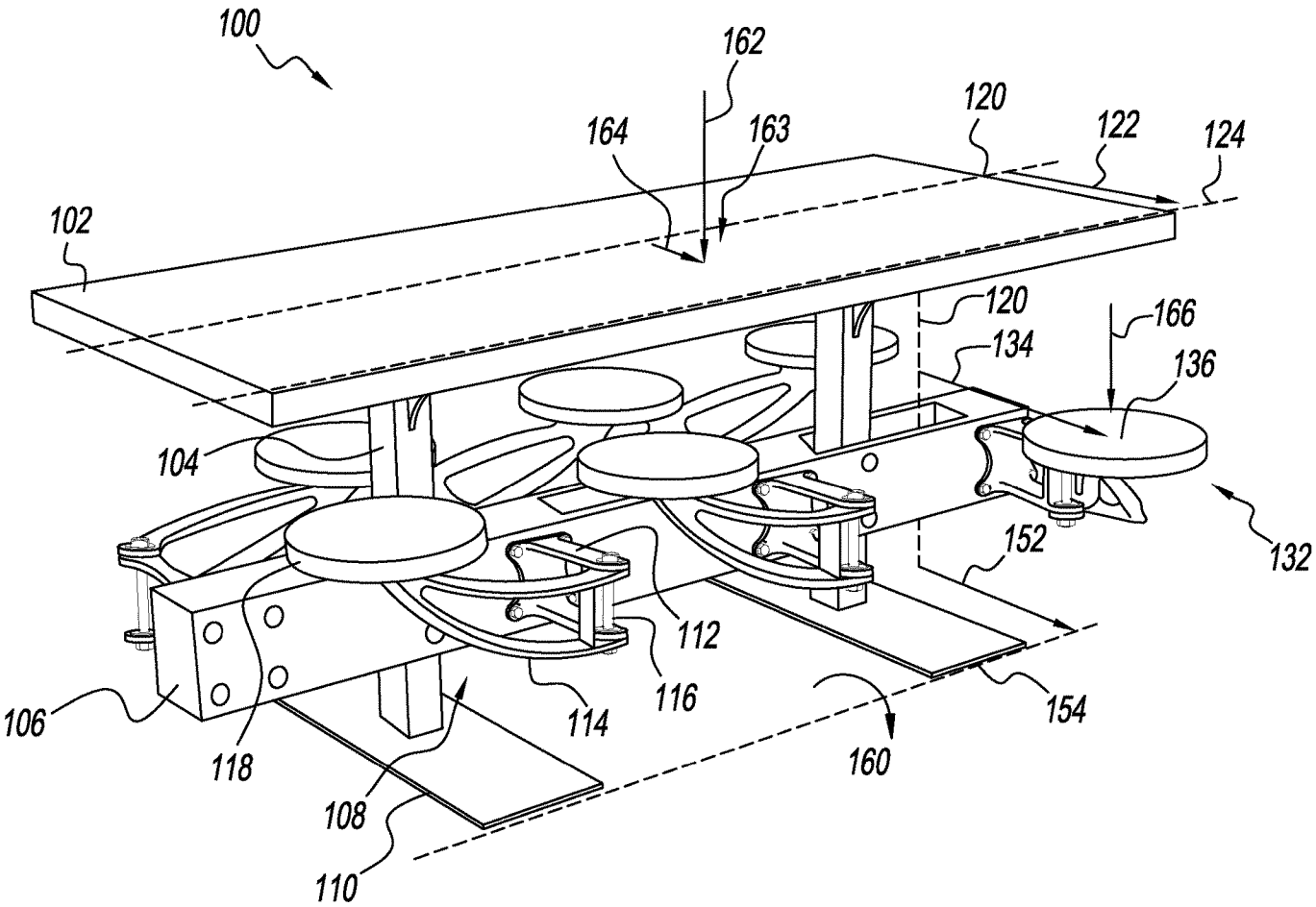
FIG. 1 (Prior Art)
FIG. 1 is a perspective drawing of a prior art swing stool table.
Figure 2:
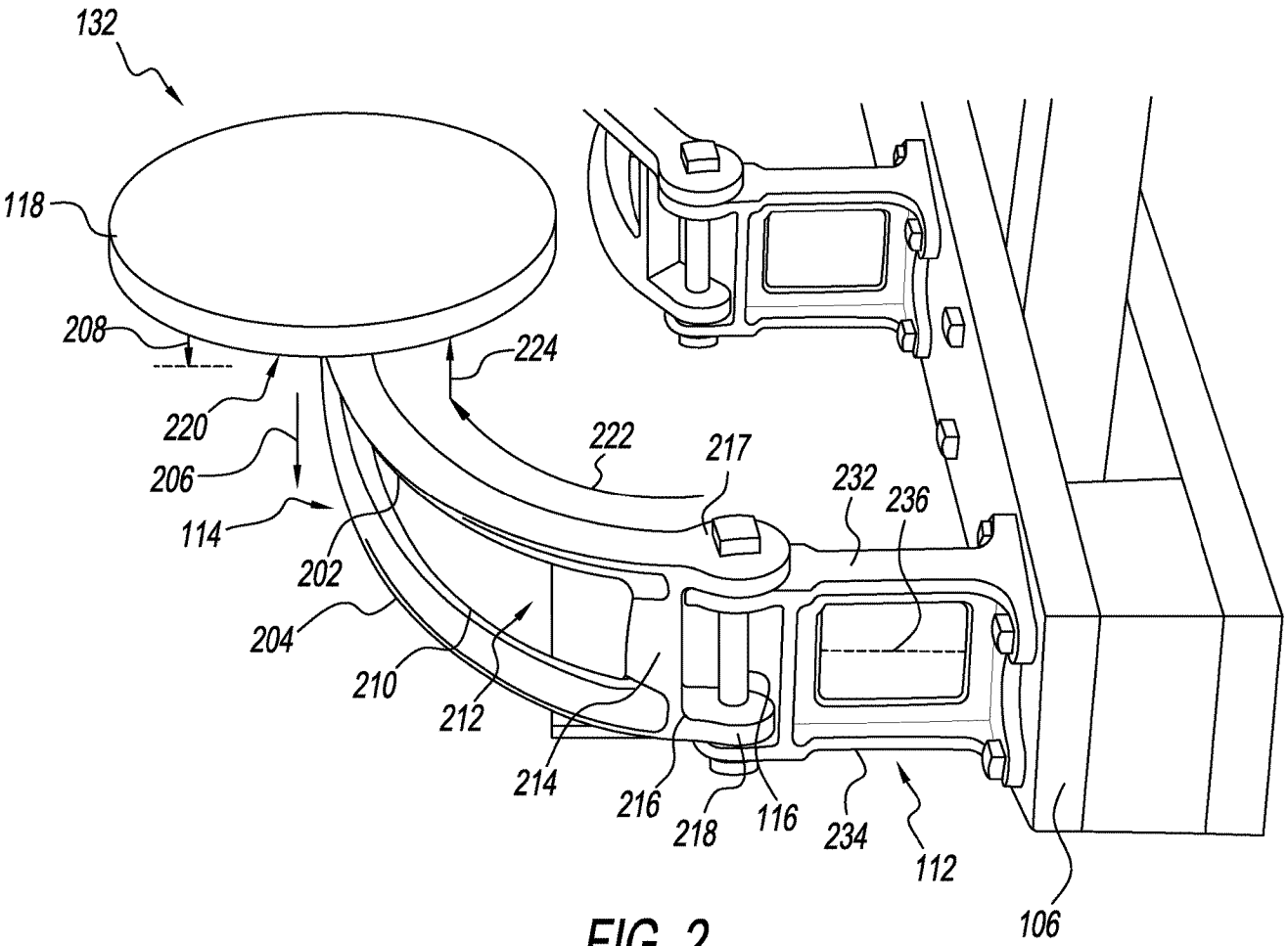
FIG. 2 (Prior Art)
FIG. 2 is a perspective drawing of a swing stool of the table of FIG. 1.

The appearance of the overall shapes of the aluminum arm 403 and bracket 407 are similar to the overall shapes of the prior art cast iron arm 114 and bracket 112 (FIG. 1), despite design differences described herein. The similarity in overall appearance is primarily for aesthetic purposes. One of the goals of the design is to provide a similar look and feel to the cast iron swing stool even though it is made from a lighter weight metal, such as aluminum. In order for a lighter weight aluminum arm to have acceptable functionality, however, additional technical modifications must be made. The thicknesses 424 of the flanges, the height 426 of the web and the length 428 of the fillet are all increased relative to the cast iron arm and bracket in order to make the arm and bracket stiffer. An increase in said dimensions of about a factor of 1.4 relative to the cast iron design is suitable for an aluminum arm and bracket. If the arm is made from a different material than aluminum, then a suitable scaling of said dimensions is done using the cube root of the ratio of the Young's modulus of said material to the Young's modulus of cast iron. For aesthetic reasons and for material savings, the thicknesses of the upper and lower flanges of the arm may be tapered from the proximal to the distal end of the arm. When designed in this manner, the calculated sag 412 of the seat plate is about the same as the sag 208 (FIG. 2) of the prior art cast iron arm.

FIG. 4B is a partial bottom view of the assembled swing stool 400 of FIG. 4A. FIG. 4B shows a detail of the pin 444 and bushing 448 sitting in the race 452 cut in the bottom disk 454 of the bracket. The nut 408 is shown with a washer 456 underneath. One end of the race acts as a stop to keep the arm from hyperextending past a given rotation when swung out. The other end of the race acts as a stop to keep the arm from folding too far in when the seat is pushed under the table. Divots 464 may be provided near the ends of the race to snap the arm into either the outward or inward positions.

Alternative Arm and Bracket Designs

Figure 5B:
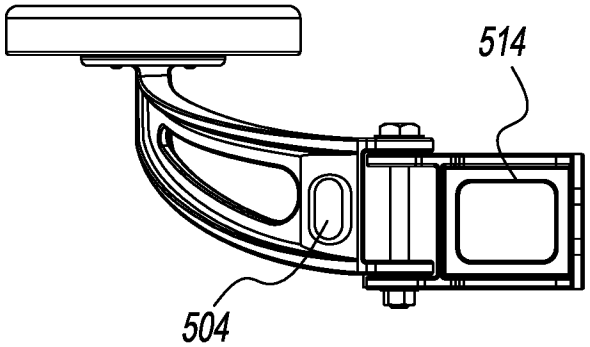
FIGS. 5A to 5C illustrate three different arm and bracket designs for a light weight swing stool.
Figure 5C:
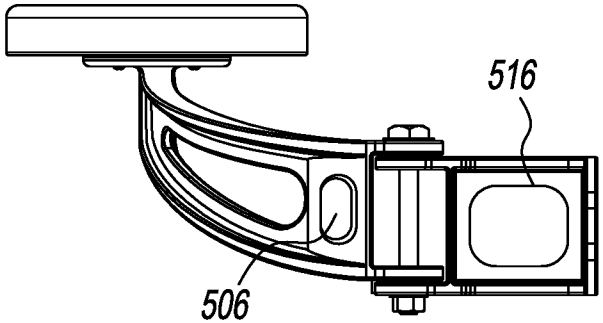
Figure 5A:
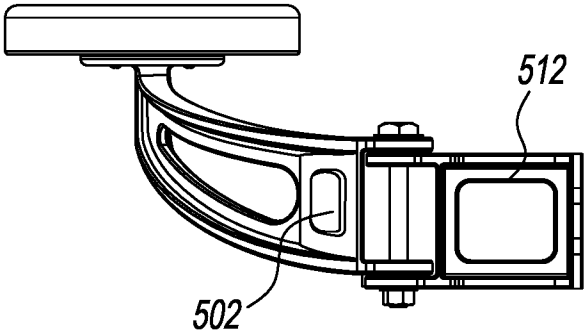
Figure 6D:
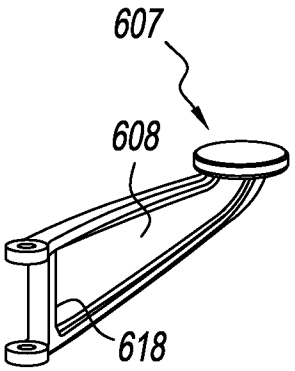
FIGS. 6A to 6D show arms for a light weight swing stool with different web designs.
Figure 6C:
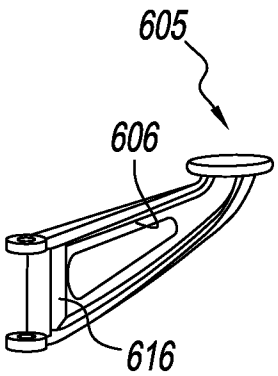
Figure 6B:
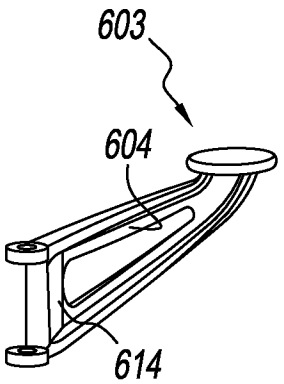
Figure 6A:
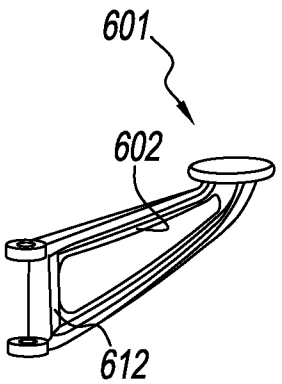

FIGS. 5A to 5C illustrate three different arm and bracket designs. They all have about the same mechanical performance and weight. The primary differences are aesthetic. The internal corners of the cavities 502, 504 and 506 are shown with radii of curvature of 1.27 cm, 2.54 cm and 1.91 cm respectively. The curvature of the inside corners of the web openings of the brackets 512, 514 and 516 are similarly shown with radii of curvature of 1.27 cm, 1.27 cm and 1.91 cm respectively.

FIGS. 6A to 6D show arms 601, 603, 605 and 607 with different web heights 602, 604, 606 and 608. Different fillet lengths 612, 614, 616 and 618 are also shown. The estimated weights, maximum deflections and maximum calculated stresses of each arm design are shown in table 1. The calculations are based on finite element analysis of arms made of 357 aluminum alloy.

TABLE 1

| Arm | Weight kg | Maximum deflection mm | Maximum stress Mpa |
|---|---|---|---|
| 601 | 2.58 | 2.92 | 88.0 |
| 603 | 2.93 | 2.11 | 73.4 |
| 605 | 2.95 | 2.01 | 73.1 |
| 607 | 3.11 | 1.93 | 72.2 |

Different designs may be used depending upon aesthetics and mechanical requirements of a particular table. Arm 601 has about the same technical design as the cast iron prior art arm. Arm 603 has twice the depth for the fillet and twice the height for the web as the prior art design. Arm 605 has a still larger web height and arm 607 has a closed web. Doubling the height of the web relative to the prior art design reduces the deflection by 38% with only a 14% increase in weight. It also preserves the general aesthetics of the prior art design.

Mechanical Specifications of an Arm Design

Figure 7B:
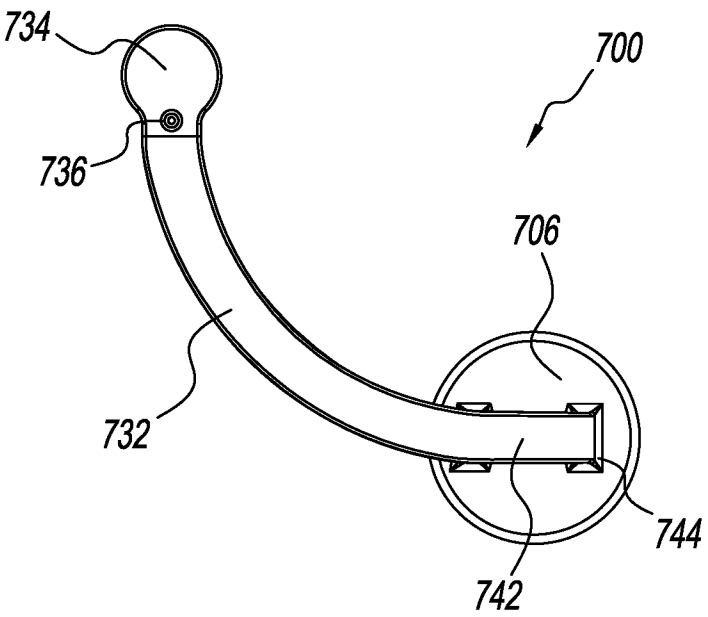
FIGS. 7A to 8D show different views of an arm from a lightweight swing stool.
Figure 7A:
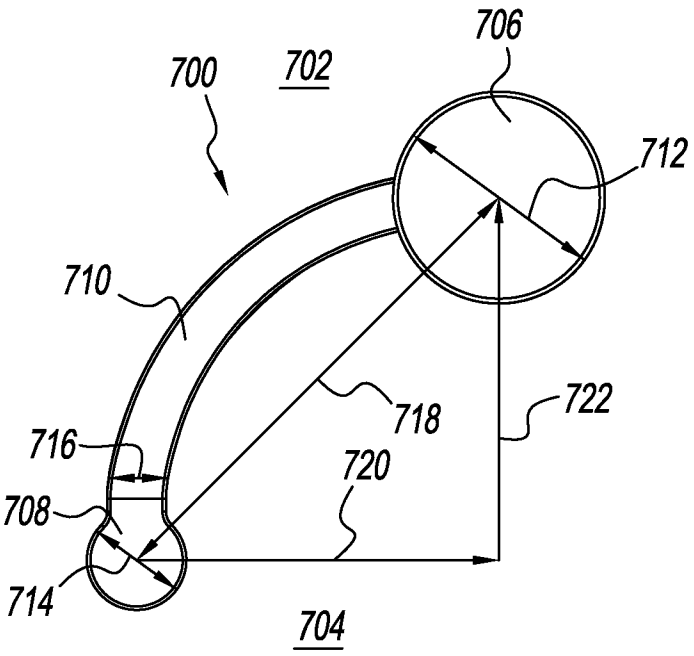

FIGS. 7A to 8D show different views of an exemplary arm design 700. The design is for a cast part before any holes are drilled in it. It is similar to the arm 403 of FIG. 4A. FIG. 7A shows a top view of the arm. The front 702 of the arm is at the top of the drawing and the back 704 of the arm is at the bottom of the drawing. The arm includes the seat plate 706 as part of the casting. The seat plate has a diameter 712 of about 14.8 cm. The top disk 708 at the proximal end of the arm has a diameter 714 of about 6.4 cm. The top flange 710 has a width 716 of about 3.6 cm. The horizontal length 718 of the arm from the center of the top disk to the center of the seat plate is about 34 cm. The arm curves to the right to give a lateral offset 720 of about 24 cm. The forward extension 722 of the arm is about the same, 24 cm. This gives a typical person enough room to sit on the swing stool without his/her right leg hitting the arm. The arm could alternatively curve to the left.

FIG. 7B is a bottom view of the arm 700. The bottom flange 732, bottom disk 734, and pin 736 can be seen. The distal end of the arm 742 bends up and joins the seat plate 706. One or more fillets 744 are provided joining the arm to the seat plate to provide extra twisting strength.

Figure 8B:
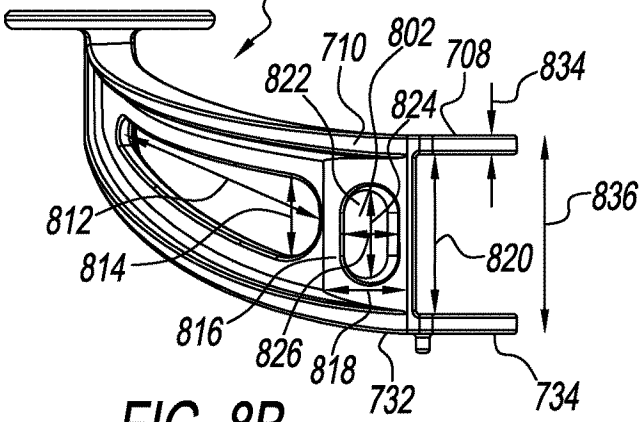
Figure 8D:
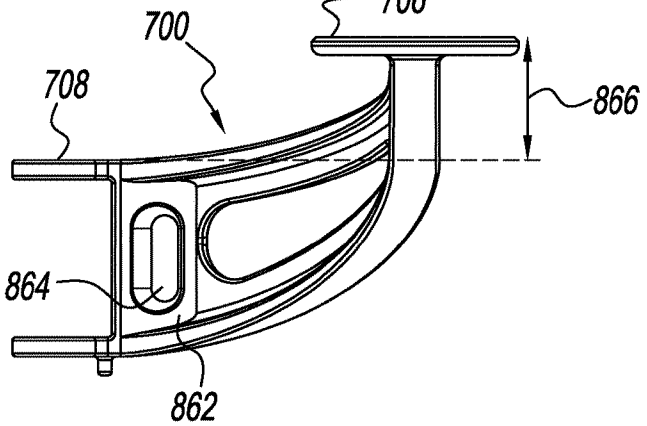
Figure 8A:
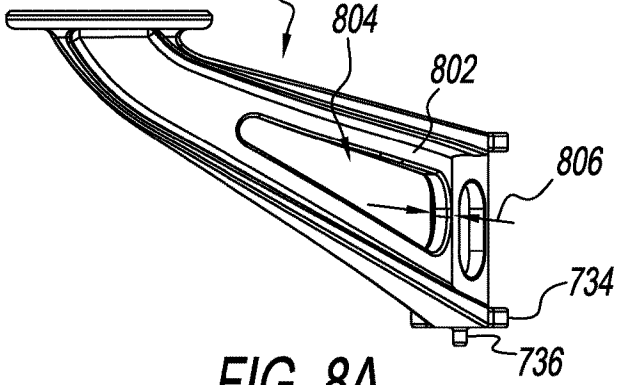

FIG. 8A is a front view of the arm 700. The web 802 and opening 804 in the web can be seen. The web has a thickness 806 of about 1.2 cm. The vertical pin 736 can be seen extending down from the bottom disk 734.

FIG. 8B is a view of the left side of the arm 700. The length 812 of the web opening is about 20 cm, or about 60% of the arm length. This is significantly less than the prior art arm, but enough to maintain a similar appearance. The smaller web opening is required to give the arm sufficient strength when made of an aluminum alloy. The height 814 of the web opening at the proximal end of the arm is about 6 cm. A left vertical fillet 816 at the proximal end of the arm can be seen. The horizontal length 818 of the fillet is about 5.4 cm or about 15% of the arm length. This is much larger than the corresponding fillet on the prior art arm. The vertical height 820 of the fillet is about 10.8 cm.

An open cavity 822 is provided in the fillet. The cavity has a banked oval shape. The depth of the cavity extends through the fillet to the web 802 underneath. The vertical height 824 of the cavity is about 8 cm and the horizontal length 826 is about 3.8 cm. The cavity is a new feature relative to the prior art arm. It allows the fillet to cool and solidify at about the same rate as the rest of the casting even though it is much thicker. This reduces the occurrence of cavities due to material shrinkage of the cast metal during solidification. It is surprising that the fillet is still effective at preventing twisting of the arm considering that a substantial part of its mass is removed by the cavity.

The vertical height 836 of the proximal end of the arm is about 13.8 cm. The thicknesses 834 of the top flange 710, top disk 708, bottom flange 732 and bottom disk 734 are all about 1.4 cm at the proximal end of the arm. The thicknesses of the top and bottom flange decrease out towards the distal end of the arm.

Figure 8C:
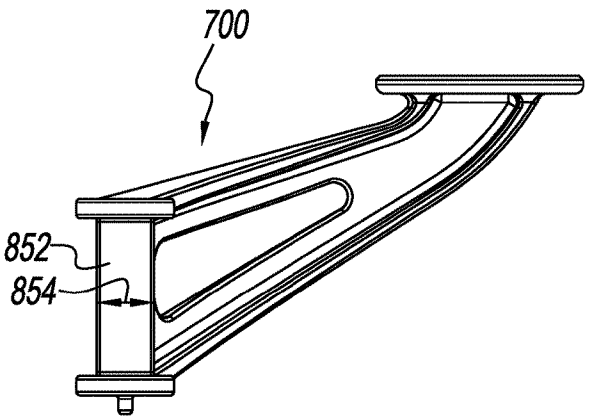

FIG. 8C is a back view of the arm 700. The end flange 852 can be seen. The width 854 of the end flange is about 4.1 cm.

FIG. 8D is a view of the right side of the arm 700. A right fillet 862 and right cavity 864 can be seen. The left and right fillets and their corresponding cavities have about the same shape except one is curved to the right and the other is curved to the left. The height 866 of the top of the seat plate 706 above the top of the top disk 708 is about 8.8 cm.

Swing Stool Table Kit

Figure 9:
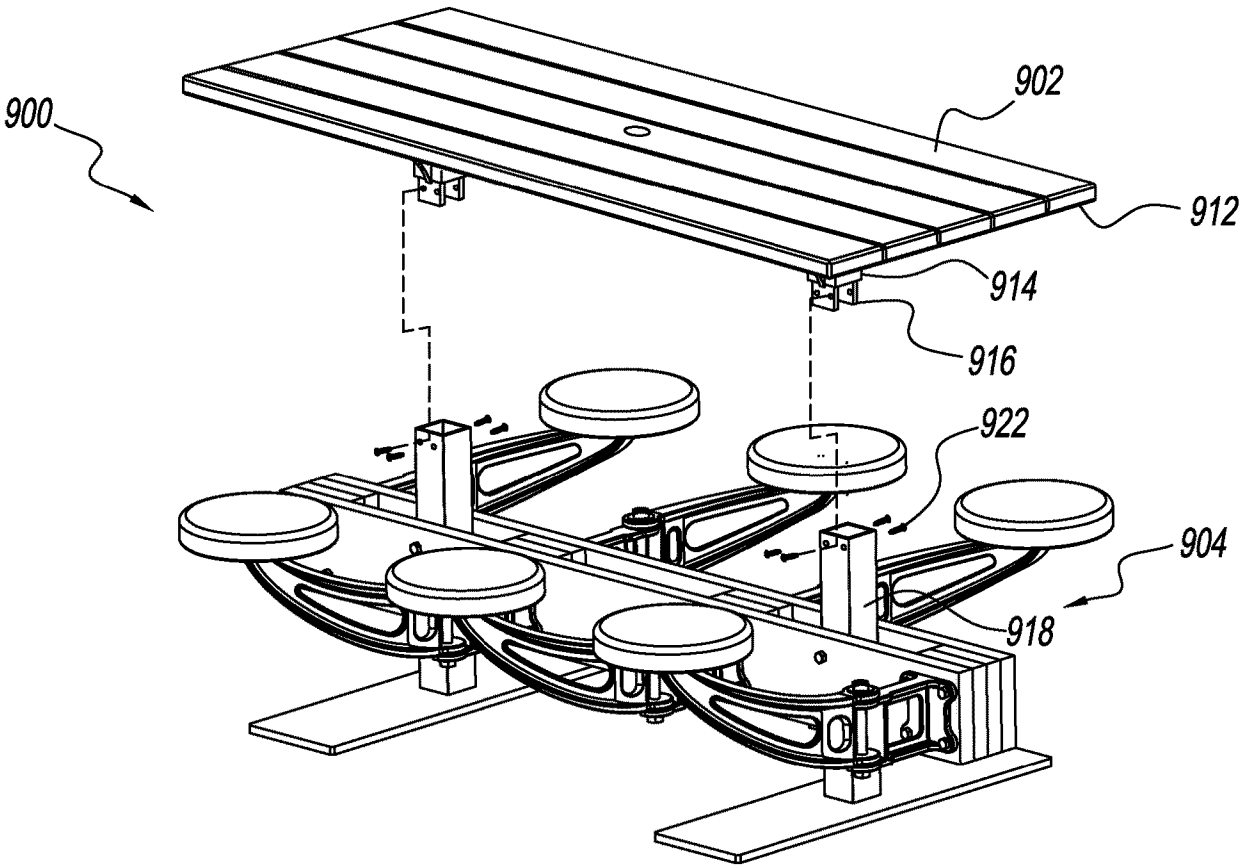
FIG. 9 is a perspective drawing of a partially assembled and partially exploded swing stool table kit.

FIG. 9 is a perspective drawing of a partially assembled and partially exploded exemplary swing stool table kit 900. The table kit comprises a top assembly 902 and base assembly 904. The top assembly comprises one or more horizontal longitudinal boards 912, and one or more vertical top posts 914 attached to the underside of said boards. The base assembly comprises one or more vertical bottom posts 918 that align with the top posts of the top assembly. The bottom posts have a hollow square cross section. Any cross section may be used. The top posts comprise tabs 916 which extend downward and align with the inside surfaces of the bottom posts. When assembled, the tabs fit into the bottom posts and are held in place by one or more screws 922 or other fastener, such as a cotter pin. Any joining means may be used.

Figure 10:
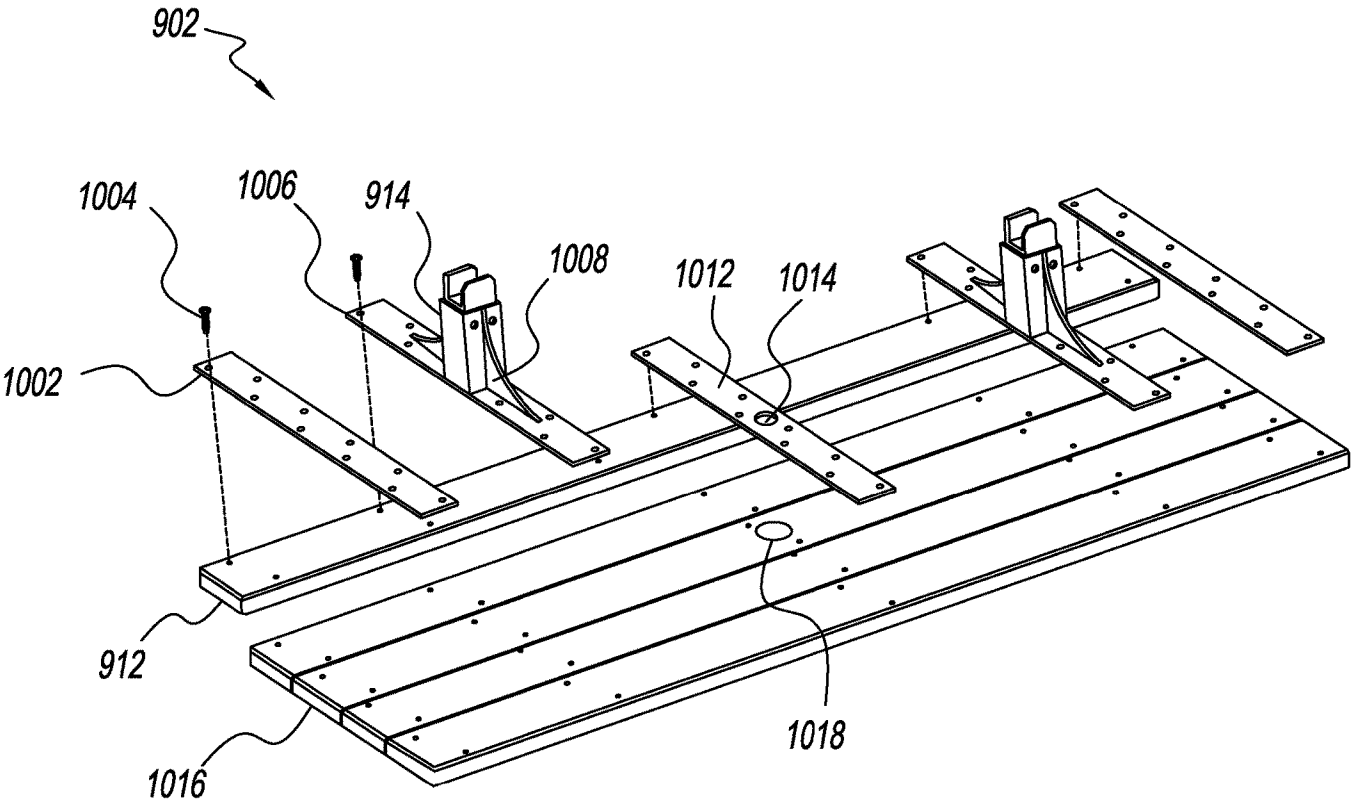
FIG. 10 is a perspective drawing of an inverted, partially assembled and partially exploded top assembly of a swing stool table kit.

FIG. 10 is a perspective drawing of an inverted, partially assembled and partially exploded top assembly 902. The top assembly comprises one or more horizontal longitudinal boards 912, one or more screw plates 1002, one or more post plates 1006 with a top post 914 extending at right angles therefrom, and a center plate 1012 comprising a center plate hole 1014 at about its midpoint. The post plate may optionally comprise angled braces 1008 to strengthen the joint to the top post. All of the plates may be attached to the boards by one or more screws 1004. The screws may be wood screws and/or self-tapping screws. Any attachment means may be used. A center board 1016 may comprise a center board hole 1018 at about its midpoint. The center board hole may align with the center plate hole when the top is assembled. The aligned holes may serve as a receptacle for a post, such as an umbrella post, when the table is used outdoors.

Figure 11A:
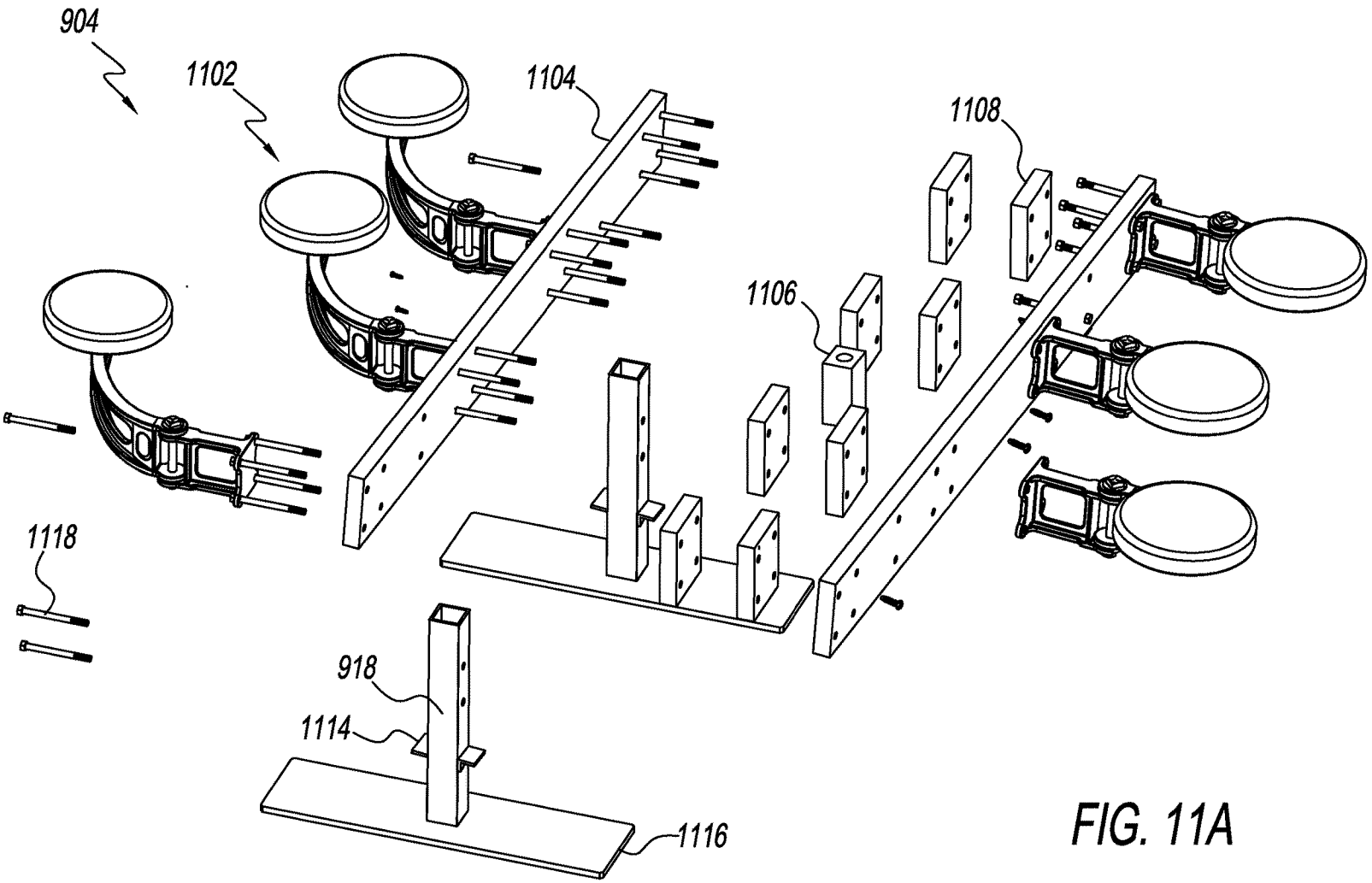
FIG. 11A is a perspective drawing of a partially exploded and partially assembled base assembly of a swing stool table kit.
Figure 11B:
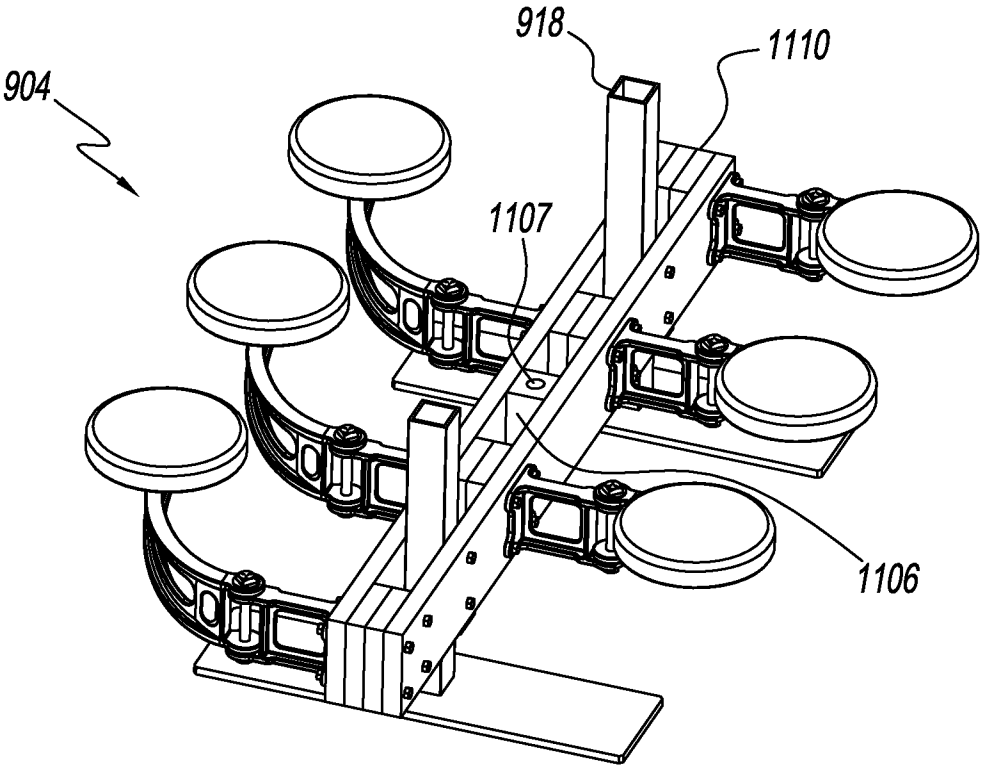
FIG. 11B is a perspective drawing of an assembled base assembly of a swing stool table kit.

FIG. 11A is a perspective drawing of a partially exploded and partially assembled base assembly 904. FIG. 11B is a perspective drawing of the assembled base assembly 904. The base assembly comprises one or more swing stools 1102, one or more longitudinal support planks 1104, a vertical center sleeve 1106, one or more spacer planks 1108 and one or more vertical bottom posts 918. Each bottom post may comprise a stop 1114 that is at an intermediate height and extends outward from the post. Each bottom post may comprise one or more lateral horizontal footplates 1116 joined at right angles thereto. One or more long bolts 1118 are provided to attach the swing stools to their respective support planks. Holes for said bolts may be provided in said planks. Corresponding holes may be provided in said spacer planks. Thus as seen in FIG. 11B, when the base assembly is assembled, the bolts pass through the swing stools and planks to sandwich the bottom posts 918 therebetween. The combined support planks and spacer planks form a longitudinal beam 1110. The stops on the bottom posts keep the beam at a desired height. The center sleeve 1106 is also sandwiched therebetween. A vertical center hole 1107 in the center sleeve is aligned with the center holes in the top assembly to hold the above described umbrella pole in a vertical orientation.

CONCLUSION

While the disclosure has been described with reference to one or more different exemplary embodiments, it will be understood by those skilled in the art that various changes may be made and equivalents may be substituted for elements thereof without departing from the scope of the disclosure. In addition, many modifications may be made to adapt to a particular situation without departing from the essential scope or teachings thereof. Therefore, it is intended that the disclosure not be limited to the particular embodiment disclosed as the best mode contemplated for carrying out this invention.

We claim:

1. A swing stool arm adapted to:

a) hold a horizontal seat at a distal end of said swing stool arm; and b) form a hinged joint at a proximal end of said swing stool arm with a bracket wherein said swing stool arm comprises:

c) a horizontal top flange;

d) a horizontal bottom flange;

e) a vertical end flange at said proximal end of said arm;

f) a web extending down from said top flange and up from said bottom flange; and g) a vertical fillet at said distal end of said swing stool arm reinforcing said swing stool arm, wherein said vertical fillet:

i) joins said vertical end flange to said web; and ii) comprises an open cavity such that said swing stool arm may be made from a cast molten aluminum alloy without forming shrinkage cavities.

2. The swing stool arm of claim 1 wherein said open cavity extends through said vertical fillet to said web below said vertical fillet.

3. The swing stool arm of claim 1 wherein said swing stool arm is bent such that it has a lateral extension and a forward extension and wherein said lateral extension has about the same length as said forward extension.

4. The swing stool arm of claim 1 which further comprises:

a) a horizontal seat plate at said distal end; and b) a top disk at said proximal end.

5. The swing stool arm of claim 4 which further comprises an opening in said web and wherein:

a) said opening in said web has a horizontal length;

b) said swing stool arm has a horizontal length between a center of said top disk and a center of said seat plate; and c) said length of said opening of said web is not more than 60% of said horizontal length of said swing stool arm.

6. The swing stool arm of claim 1 which further comprises:

a) a top disk at said proximal end of said arm wherein said top disk extends horizontally from said top flange and said top disk comprises a center hole;

b) a bottom disk at said proximal end of said arm wherein said bottom disk extends horizontally from said bottom flange and said bottom disk comprises a center hole;

c) a vertical pin extending downward from said bottom disk of said swing stool arm; and d) a bushing mounted on said pin wherein said swing stool arm is adapted to be hingedly joined to said bracket using said top disk and said bottom disk and wherein said vertical pin and said bushing are adapted to interact with said bracket such that said swing stool arm will not hyperextend when swung out from said bracket.

7. The swing stool arm of claim 1 wherein said swing stool arm is made from a cast aluminum alloy.

* * * * *